US005522244A

United States Patent [19]

Eigenmann et al.

[11] Patent Number: 5,522,244

[45] Date of Patent: Jun. 4, 1996

[54] METHOD OF OPERATING A PUNCH PRESS DURING START-UP AND STOPPING

[75] Inventors: Oskar Eigenmann; Helmut Messner, both of Arbon, Switzerland

[73] Assignee: Bruderer AG, Frasnacht, Switzerland

[21] Appl. No.: 148,689

[22] Filed: Nov. 5, 1993

[30] Foreign Application Priority Data

Nov. 11, 1992 [CH] Switzerland ..... 3479/92

[51] Int. Cl.[6] ..... B21J 9/20

[52] U.S. Cl. ..... 72/21.3; 72/444

[58] Field of Search ..... 72/21, 444, 26, 72/452

[56] References Cited

U.S. PATENT DOCUMENTS

| | | | |
|---|---|---|---|
| 3,888,097 | 6/1975 | Fortman et al. | 72/444 |
| 4,510,570 | 4/1985 | Yonekura | 72/21 |
| 4,653,311 | 3/1987 | Tack, Jr. | 72/443 |

FOREIGN PATENT DOCUMENTS

| | | | |
|---|---|---|---|
| 2414435 | 10/1975 | Germany . | |
| 2853143 | 8/1979 | Germany . | |
| 3525010 | 1/1986 | Germany | 72/21 |
| 60-064799 | 4/1985 | Japan . | |

*Primary Examiner*—David Jones
*Attorney, Agent, or Firm*—Ladas & Parry

[57] ABSTRACT

When starting up the punch press its eccentric shaft must accelerate through a start-up angle from the resting state up to the operating speed of rotation due to the forces of inertia of the moving structures of the punch press. When stopping the punch press the eccentric shaft is rotated in the direction of normal operation into a position between the upper dead center and the lower dead center position, in which latter position no contacting between the upper tool and the metal strip to be worked upon takes place. From this position the eccentric shaft is rotated backwards by the start-up angle into a start-up angle position. In the start-up angle position again no contact between the upper tool and the strip takes place. Accordingly, an enlarged start-up angle which has been increased backwards over the upper dead center position is available for the start-up of the punch press, such that the first punching is executed at the same dynamic conditions of the punch press as the next subsequent punching operations, such that when starting the punch press up precise products are produced already by the first stroke.

3 Claims, 2 Drawing Sheets

METHOD OF OPERATING A PUNCH PRESS DURING START-UP AND STOPPING

BACKGROUND OF THE INVENTION

1. Field of the Invention

The present invention relates to a method of operating a punch press during start-up and stopping operations. In particular the punch press includes a positionable drive; a coupling/brake device having a coupling and a braking unit including structural members which move during the operation of the punch press; moving structural members including an eccentric shaft driven by a positionable drive via the coupling unit of the coupling/ brake device; at least one push rod supported on the eccentric shaft; a ram pivotably mounted to the at least one push rod to be driven by the eccentric shaft; an upper tool including at least one working tool, the upper tool being pivotably mounted to the at least one push rod; a stationary punch press table; and at least one lower tool mounted to the punch press table; so that the upper and lower tools work on a strip-like workpiece located therebetween. The eccentric shaft of the punch press, due to the total inertia moment of the moving structural members of the punch press and due to the driving torque transmitted by the coupling unit of the coupling/brake device, rotates during their acceleration from a stand-still state to the state of rotating at the operationally rated number of strokes through start-up angles to a predetermined operation angle where a first contact between the at least one working tool and the strip-like workpiece occurs.

2. Description of the Prior Art

It is a generally known fact that in high-speed punch presses the known increasing of the forces of inertia of the accelerating structural members pose a large problem at an increasing rotational speed or number of strokes, resp., which problem has specifically an influence onto the quality and preciseness of products produced by such high-speed punch presses. Due to the accelerations and decelerations of the predominantly oscillating structural members and due to the counterforces produced during the working of a respective workpiece the punch press and specifically its moving parts suffer elastic deformations and displacements occur, furthermore, in the various bearings, which have quite a negative influence on the preciseness at the produced products.

The precision of a punched product depends among others strongly from the respective height position of the ram. As is generally known to the persons skilled in the prevailing art, this height position of the ram determines or sets, respectively, the closed tool height position or the depth of penetration at the operating of the machine.

If a fixed height position of the ram is set for predetermined or given, respectively, stamping, embossing and cutting operations at a given number of strokes, it is a commonly known fact that e.g. the embossments do not reach the rated or designed, respectively, depth when the punch press operates at a relatively low number of strokes and conversely, the embossings have a too large depth or the depth of penetration of the punching tools, respectively, is too large at a higher number of strokes which latter condition leads, as is generally known, to undesirably large wear at the corresponding tool members.

A variety of procedures for a controlling of the height position of the ram or depth of penetration, respectively, based on the number of strokes, have become known.

Reference is made here for instance to the Swiss patent specification CH-A-676 445.

During a punching operation, and specifically if such operation proceeds by means of multiple press tools, there is the desire that no waste is produced also during the start-up and stopping of the punch press due to the above mentioned forces of inertia and specifically in case of high-speed punch presses the start-up and stopping operation causes considerable troubles in this respect.

when starting a punch press up, initially the drive, generally an electric motor is energized and run up to the rated operational speed, i.e. the rated operational number of strokes of the punch press. For the start-up proper of the punch press, its eccentric shaft is coupled by a closing of the coupling to the drive motor rotating already at a rated operational speed and specifically to the fly-wheel and accordingly accelerated from the state of stand-still up to the rated rotational speed. The dynamic behavior of the punch press during the first or initial working operation, e.g. the first punching operation, is thereby defined first punch behavior or first impact behavior of the punch press and it is this first punch behavior which determines the quality of the first punched product of a running series of punched products made during the operating of the punch press.

At the known start-up methods of high-speed punch presses, this first punch behavior is now such that the first punching operation is not made at the rated operating number of strokes such as during the next subsequent, then continuous punching operations, i.e. the dynamic behavior of the punch press during the first stroke is quite different from the subsequent strokes which has a quite negative effect regarding the precision of the first part produced.

A reduction of the operating number of strokes could obviously eliminate this drawback, but then the production is decreased, i.e. the number of products produced within a given time span is lower.

SUMMARY OF THE INVENTION

A general object of the present invention is to provide a method of operating a punch press by means of which the punch press operates during the start-up cycle already at the first operating stroke at the rated number of strokes of its continuous operation.

A further object is to provide a punch press wherein after the punch press has been brought to a standstill, its eccentric shaft is rotated for a subsequent start-up to a start-up or rest position without passing through its lower dead center position.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENT

Figure 1:
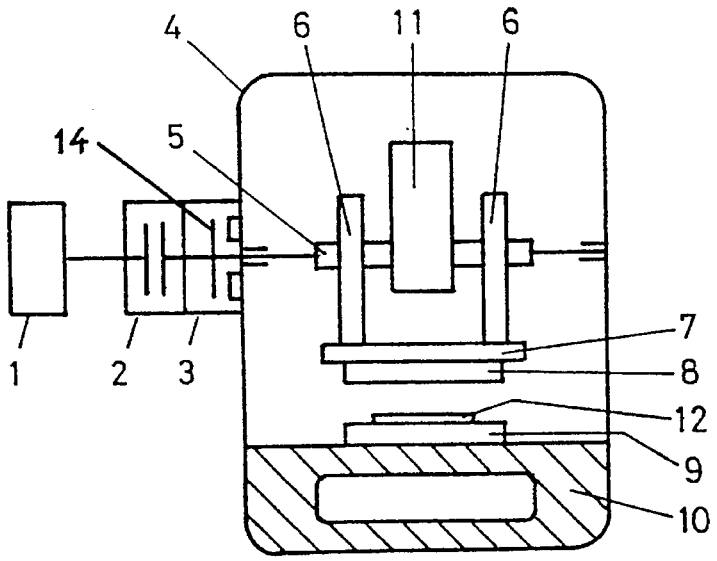
FIG. 1 illustrates on a purely schematic basis a punch press with its main components for ease of understanding the present invention.

FIG. 1 illustrates schematically a punch press. This punch press includes a positionable drive 1. Such a positionable drive 1 includes, as generally known, an electromotor which can be controlled in such a manner that it can be rotated to or brought to rest at any desired angular position. The electromotor drives the flywheel of the high-speed punch press via a belt in accordance with the generally known designs. The flywheel is coupled to a coupling/brake device 2, 3 which in turn is connected to the eccentric shaft 5 supported in the machine frame 4.

The coupling/brake device 2,3 includes a coupling unit 2, by means of which the eccentric shaft 5 can be coupled to the drive 1, i.e. its flywheel, and conversely can be uncoupled therefrom, and includes a braking unit 3 having a brake disc 14, by means of which the eccentric shaft 5 can be braked against the frame 4 of the machine. Particulars of this coupling/ brake device are disclosed in the Swiss patent specification CH-A-546 141 or the U.S.-patent specification U.S. Pat. No. 3,804,931. Important to note in this regard is that the coupling unit 2 and the braking unit 3 are force locking designs, i.e. when the coupling is closed and when the brake is applied, a sliding behavior occurs between the structural members contacting each other.

The eccentric shaft 5 supports connecting rods 6, which in turn support the ram 7. The upper tool 8 is mounted to this ram 7. FIG. 1 illustrates, furthermore, the table 10 of the punch press, which table 10 supports the lower tool 9. Reference numeral 11 identifies in a general manner the balancing weight structures which balance the rotating and oscillating forces occurring during the operation of the punch press.

Figure 3:
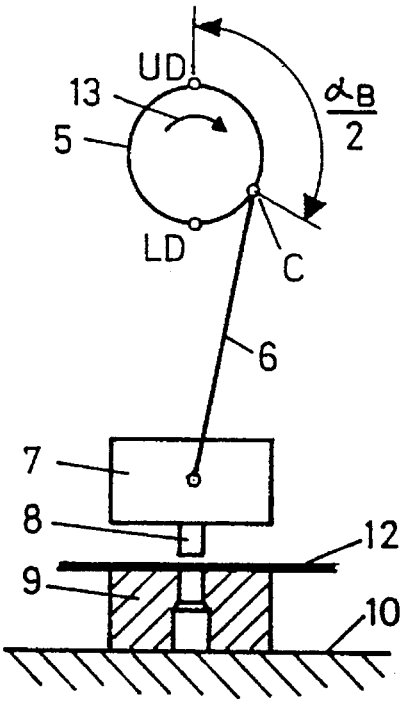
FIG. 3 illustrates schematically the position of a punch press operated in accordance with the inventive method after having stopped.
Figure 4:
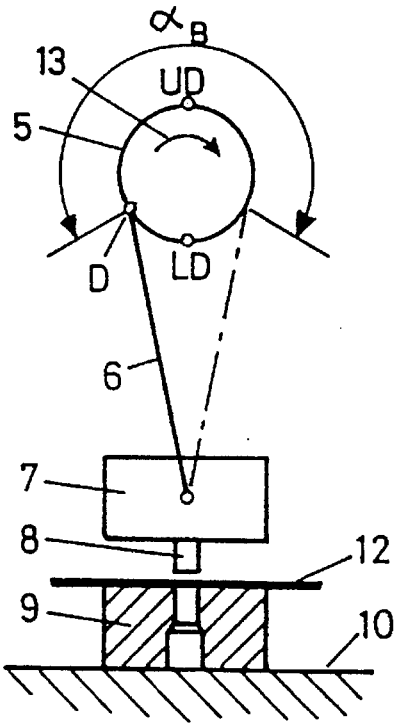
FIG. 4 illustrates schematically the position of a punch press operated in accordance with the inventive method prior to the start-up.

In operation the eccentric shaft rotates through all angular positions of a 360° angle and, due to the positionable drive, the shaft can be brought to a stand-still at any desired angular position. In punch presses it is common to define for their eccentric shafts an upper dead center angular position UD and a lower dead center angular position LD, whereby the structural reference for these positions is taken to be the pivotal point of the connecting rod(s) at the eccentric shaft 5. In its upper dead center position UD the ram 7 is at the largest and in the lower dead center position LD the ram 7 is at the smallest distance from the table 10 of the punch press. These positions UD and LD are illustrated in FIGS. 3 and 4.

In interrupting an operation, i.e. stopping a punch press, it has been common to bring the punch press to rest, i.e. positioned, at least approximately in its upper dead center position UD. The distance between the ram 7 and the punch press table 10 is at its largest in this position of the punch press (i.e. the eccentric shaft) and the tool (consisting of upper tool 8 and lower tool 9) is in its open state. In order to interrupt the operation of the punch press the coupling unit 2 is opened. As a result, uncoupled and simultaneously the braking unit 3 is closed, i.e. the eccentric shaft 5 is decoupled from the drive 1, while the drive 1 and the flywheel keep on running at the rated operating speed of the punch press and the eccentric shaft 5 comes to a standstill.

Figure 2:
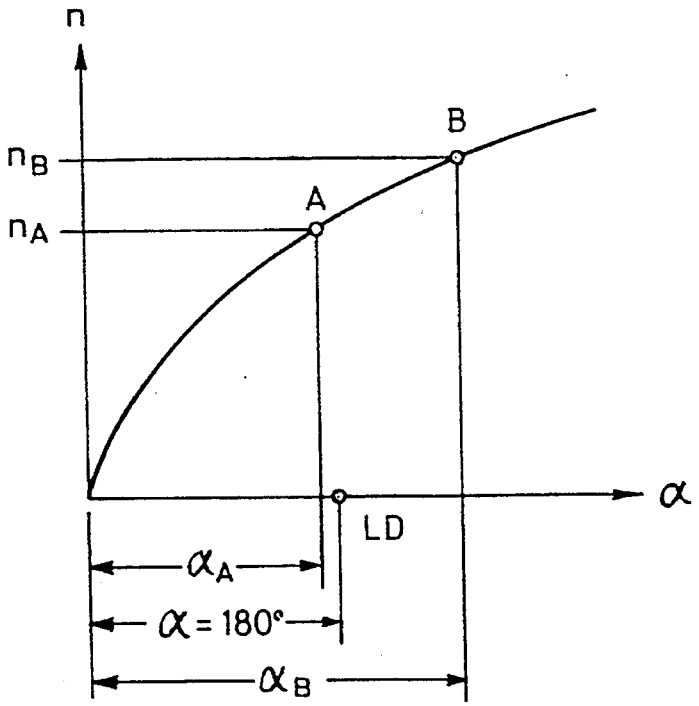
FIG. 2 is a diagram illustrating the behavior of a punch press during start-up.

Reference is now made to FIG. 2. The abscissa refers to the angular position $\alpha$ of the eccentric shaft 5 and the ordinate refers to the speed of rotation n of the eccentric shaft 5.

It shall be assumed that the drive of the punch press is rotating at the rated operational speed $n_B$and the eccentric shaft is at rest in the upper dead center position UD. If then the braking unit is opened and the coupling unit closed, the rotational speed n of the eccentric shaft begins to increase from zero under the influence of the torque transmitted via the coupling onto the eccentric shaft. This increasing rotational speed n relative to the angular position $\alpha$ of the eccentric shaft is illustrated in FIG. 2 by the curved line. After a certain time i.e. after the eccentric shaft has rotated from its rest position that, in this case, was assumed to be about the upper dead center position UD, as has been the practice, through a certain angle $\alpha_B$ of rotation, the rated operational speed $n_B$ is arrived at. The certain angle $\alpha_B$ is, therefore, hereinafter called the operational-speed angle. The change of the speed of rotation proceeds, thereby, according to the formula $$n=\sqrt{\frac{\alpha \cdot M \cdot 10}{J \cdot \pi}}\text{, whereby}$$

M= is the driving torque output of the coupling [Nm],

J= the moment of inertia of the moving structural members of the punch press [$kgm^2$]

$\alpha$=Start-up or stopping angle in degrees.

The closing of the tool, i.e. the contact between the upper tool and the strip to be worked upon, for performing an operation thereon occurs shortly ahead of the lower dead center position LD, at which the eccentric shaft has rotated through an angle of rotation, i.e. a start-up angle, $\alpha_A$ , from its rest position that, in this case, was assumed to have been about the upper dead center position UD, as has been the practice. This is shown in FIG. 2 by the space between the start-up angle $\alpha_A$ and the angle $\alpha$=180° which corresponds to lower dead center position LD.

The rated operational speed $n_B$ must be arrived at, at the latest by the start-up angle $\alpha_A$ if the first punching, i.e. operation performed by the first contact of the upper and lower tools with the strip, during start-up shall be performed at the same dynamic conditions as will prevail at the next and subsequent pouncing operations. Thus, at any rated operational speed $N_B \leqq n_A$, no difficulties occur. On FIG. 2 this would require the point B to be left of the point A the eccentric shaft has rotated through the start-up angle $\alpha_A$ that is less than $\alpha$=180° (LD).

If now the rated operational speed $n_B$ is larger than $n_B$, i.e. $n_B \geqq n_A$, as shown in FIG. 2 and occurs in high-speed punch presses, the operational-speed angle $\alpha_B$ is larger than the start-up angle $\alpha_A$, and the first punching operation does not have the same dynamic conditions as present at the next and subsequent punching operations.

When stopping the punch press the same thoughts are to be made. A decrease of the number of strokes can be initiated only after the lower dead center LD has been passed, whereby the complete standstill must have been reached prior to a rotation of 360°, i.e. before a further contact between tool and metal strip is made.

The parameters M (driving torque or operating torque) and J (moment of inertia) of a punch press can be changed only with high expenditure or great difficulties or, generally, not at all. Accordingly, the inventive method is used which will now be explained based on FIGS. 3 and 4.

Because the rated operational speed of rotation n and the machine parameters M and J are known, it is possible to calculate e.g. in a control apparatus for the punch press the start-up angle $\alpha_B$ and correspondingly also the stopping or braking angle.

When shutting the punch press down it is brought to rest in accordance with the invention not in the upper dead center position UD but rather at the angular position C (FIG. 3), which is located by the angle $\alpha_B/2$ after the upper dead center UD (seen in direction of rotation).

Obviously, the maximum size of $\alpha_B/2$ is such that large that the lower dead center LD is not reached and accordingly a further punching is avoided. When stopping a punch press the coupling is opened and the brake is closed, whereby the drive including the fly-wheel continues rotating at the rated operational speed of the punch press.

Now, after the punch press, i.e. the eccentric shaft, has been brought to rest at the angular position C, the drive is also stopped. Thereafter the drive is again operated but now in the direction of rotation opposite of the normal direction of the rotation and thereafter the coupling is closed such that the eccentric shaft is again coupled to the drive and then the eccentric shaft is rotated by the angle $$2 \times \frac{\alpha_B}{2} = \alpha_B$$

backwards into the angular position D illustrated in FIG. 4. After having arrived at the angular position D, the coupling 2 is opened and the drive 5 brought to rotate in the direction of normal operation of the eccentric shaft and accelerated up to the rated operational speed of rotation $n_B$. The eccentric shaft 5 is at rest in the angular position D and accordingly an enlarged start-up angle $\alpha_B$ is now available for a coupling on and starting the rotation of the punch press such that the speed of rotation of the eccentric shaft 5 corresponds at the latest at the position C to the rated operational speed thereof.

It has been mentioned that it has been common practice to stop the punch press at the upper dead center UD allowing a manipulating in the opened tool. When the press, i.e. the eccentric shaft, is rotated backwards from the position C to the position D, it is possible, if it is desired to do so, to bring the eccentric shaft 5 to a temporary standstill at the upper dead center UD (intermediate holding), which is accomplished by a corresponding setting of the controller for the punch press.

While there is shown and described a present preferred embodiment of the invention, it is to be distinctly understood that the invention is not limited thereto, but may be otherwise variously embodied and practiced within the scope of the following claims.

We claim:

1. A method of operating a punch press during start-up operations, the punch press having:

a positionable drive;

an eccentric shaft;

a coupling/brake device for driving the eccentric shaft from the positionable drive and stopping the eccentric shaft;

at least one push rod supported on the eccentric shaft;

a ram pivotably mounted to the at least one push rod so as to be driven by the positionable drive through the eccentric shaft and at least one push rod;

a stationary punch press table;

an upper tool on the ram and at least one lower tool mounted to the punch press table for contacting a workpiece between the upper and lower tools;

wherein the eccentric shaft, due to a total inertia and due to a torque of the driving of the coupling/brake device accelerates from a rest position to a rated operational speed through a start-up angle to where the contact between the tools and the workpiece first occurs;

the method comprising:

rotating the eccentric shaft after the eccentric shaft has been stopped to the rest position for subsequent start-up driving via the coupling/brake device without passing through a lower dead center position of the eccentric shaft; and accelerating the eccentric shaft from the rest position with the drive thereof during the start-up through an operational-speed angle in a normal operating direction of rotation ahead of a start-up angle.

2. In a method of operating a punch press having an eccentric shaft that rotationally accelerates through an operating-speed angle from a rest position to a rated operational speed and had a start-up angle of the rotation from the rest position to a position in which an upper tool that is moved by the rotation of the eccentric shaft first contacts a workpiece on a lower tool, the improvement comprising:

stopping rotation of the eccentric shaft in an operating direction;

rotating the eccentric shaft to the rest position in a direction that does not press through a lower dead center position of the eccentric shaft; and locating the rest position such that the operating-speed angle is smaller than the start-up angle;

whereby the punch press will have reached its rated operational speed during start up before the upper tool first contacts the workpiece and such first contact will have the same dynamic effect as next and subsequent operations.

3. In the method of claim 2, the further improvement wherein the direction of the rotating of the eccentric shaft to the rest position is opposite to the operating direction and wherein the rotating is one of continuous and temporarily stopped at an upper dead center position.

* * * * *